US006550433B2

(12) United States Patent
Vorih et al.

(10) Patent No.: US 6,550,433 B2
(45) Date of Patent: Apr. 22, 2003

(54) ENGINE VALVE ACTUATOR WITH VALVE SEATING CONTROL

(75) Inventors: Joseph M. Vorih, West Suffield, CT (US); Kevin J. Kinerson, Vernon, CT (US); Mark A. Israel, Amherst, MA (US); Richard E. Vanderpoel, Bloomfield, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 10/176,709

(22) Filed: Jun. 24, 2002

(65) Prior Publication Data

US 2002/0185091 A1 Dec. 12, 2002

Related U.S. Application Data

(62) Division of application No. 09/143,403, filed on Aug. 28, 1998, now Pat. No. 6,412,457.

(60) Provisional application No. 60/078,113, filed on Mar. 16, 1998, provisional application No. 60/067,559, filed on Dec. 5, 1997, and provisional application No. 60/056,089, filed on Aug. 28, 1997.

(51) Int. Cl.[7] ..... F01L 1/34

(52) U.S. Cl. ..... 123/90.15; 123/90.12; 123/90.13; 123/90.16; 123/90.46; 123/90.48; 123/90.49; 123/90.55

(58) Field of Search ..... 123/90.12, 90.13, 123/90.15, 90.16, 90.46, 90.48, 90.49, 90.55

(56) References Cited

U.S. PATENT DOCUMENTS

| | | | | |
|---|---|---|---|---|
| 4,206,728 A | | 6/1980 | Trenne | |
| 4,862,844 A | * | 9/1989 | Wakeman et al. | 123/90.12 |
| 4,889,084 A | | 12/1989 | Rembold | |
| 4,924,821 A | * | 5/1990 | Teerman | 123/90.22 |
| 5,127,375 A | * | 7/1992 | Bowman et al. | 123/90.12 |
| 5,158,048 A | | 10/1992 | Robnett et al. | |
| 5,221,072 A | | 6/1993 | Erickson et al. | |
| 5,275,136 A | * | 1/1994 | Schechter et al. | 123/90.12 |
| 5,460,131 A | | 10/1995 | Usko | |
| 5,485,813 A | | 1/1996 | Molitor et al. | |
| 5,503,120 A | * | 4/1996 | Shirey et al. | 123/90.12 |
| 5,537,976 A | | 7/1996 | Hu | |
| 5,577,468 A | | 11/1996 | Weber | |
| 5,582,141 A | | 12/1996 | Meyer | |
| 5,606,940 A | | 3/1997 | Shafer et al. | |
| 5,619,964 A | | 4/1997 | Feucht | |
| 6,024,060 A | * | 2/2000 | Buehrle et al. | 123/90.11 |
| 6,192,841 B1 | * | 2/2001 | Vorih et al. | 123/90.12 |
| 6,302,370 B1 | | 10/2001 | Schwoerer et al. | |
| 6,412,457 B1 | * | 7/2002 | Vorih et al. | 123/90.12 |

FOREIGN PATENT DOCUMENTS

DE 3815668 A1 11/1989

OTHER PUBLICATIONS

B. Gecim. "Analysis of a Lost–Motion–Type Hydraulic System for Variable Valve Actuation," for General Motors Research.

(List continued on next page.)

*Primary Examiner*—Thomas Denion
*Assistant Examiner*—Ching Chang
(74) *Attorney, Agent, or Firm*—Collier Shanon Scott, PLLC; Mark W. Rygiel; David R. Yohannan

(57) ABSTRACT

The present invention provides a hydraulic actuator for operating an engine valve, which includes a means for controlling the seating velocity of the valve. The design allows for free, unrestricted movement of the actuator piston during opening of the engine valve, and an unrestricted return of the piston and valve until the valve is within a predetermined distance of the valve seat. Once within this predetermined range, the return velocity of the actuator piston and engine valve are limited by the rate at which a fluid may escape through a restriction. The restriction is calibrated to provide the desired maximum valve seating velocity. The invention also provides for automatic lash adjustment.

16 Claims, 11 Drawing Sheets

OTHER PUBLICATIONS

F. Vattaneo. "Experiences with an Electrohydraulic Variable Valve Actuation System on a Four–Cylinder SI Engine," Fiat Research Center—Orbassano, Turin.

W. Gotz. "Hydraulics. Theory and Applications," Bosch–Quality Training, Robert Bosch GmbH, Ditzingen, Germany (1998).

Unknown. "3.7 Lost Motion Systems, Chapter 3 Approaches to Variable Valve Actuation," presented at University of Canterbury, New Zealand (Jul. 2, 1996).

Fortschritt–Berichte VDI. "14. Internationales Weiner Motorensymposium," Reihe 12, NR. 182, pp. 84–97, May 6–7, 1993.

Fortschritt–Berichte VDI. "7. Internationales Weiner Motoren–Symposium," Reihe 12, NR 74, pp. 221–243, Apr. 24–25, 1986.

* cited by examiner $D_2$ = RANGE OF CONTROLLED SEATING

ENGINE VALVE ACTUATOR WITH VALVE SEATING CONTROL

CROSS REFERENCE TO RELATED APPLICATIONS

This application is a division and claims priority to the following U.S. Non-Provisional and Provisional Applications, which are incorporated herein by reference:

| Ser. No. | Title | Filing Date |
|---|---|---|
| 09/143,403 | Engine Valve Actuator With Valve Seating Control | 8/28/98, now U.S. Pat. No. 6412457 |
| 60/078,113 | Fixed Stroke Piston with Hydraulic Damping | 3/16/98 |
| 60/067,559 | Method and Apparatus for Hydraulic Engine Valve Seating Control | 12/5/97 |
| 60/056,089 | Limited-Range, Lash-Independent Hydraulic Engine Valve Seating Control Apparatus and Method | 8/28/97 |

FIELD OF INVENTION

This invention relates to the control of engine valves associated with the combustion chamber of an internal combustion engine. In particular, the present invention is directed to an apparatus for controlling the seating of engine valves.

BACKGROUND OF THE INVENTION

Engine combustion chamber valves, such as intake and exhaust valves, are almost universally of a poppet type. These engine valves are typically spring loaded toward a valve closed position. A number of means exist for opening such valves, including hydraulic pressure. In many Systems, hydraulic pressure acts on an actuator piston within a housing or cylinder. The piston may be operatively connected to the valve stem of an engine valve. In response to hydraulic pressure on the top of the piston, the piston translates downward, forcing the engine valve open against the force of a valve spring, opening the engine valve. This hydraulic piston arrangement is commonly referred to as a hydraulic actuator.

A variety of systems exist to regulate the timing of engine valve opening by controlling the hydraulic pressure within the actuator at the top of the actuator piston. These systems include "common rail" systems in which a solenoid control valve, or other valve, opens a path from a source of high pressure fluid to the top of the slave piston at precisely timed instants. One such common rail system is described in Cosma et al., U.S. Pat. No. 5,619,964, assigned to the assignee of the present application.

Another type of system for applying hydraulic pressure to the actuator piston is a hydraulically linked master and slave piston arrangement. In such systems, a cam or other device causes motion of a master piston. Master piston motion is transferred to the actuator ("slave") piston by means of the hydraulic link between the two pistons. The motion of the slave piston, in relation to the basic cam motion imparted to the master piston, may be modified by draining and filling fluid from the hydraulic link at precise times. In this way, only selected portions of the cam-driven motion may be transferred to the slave piston. These systems are sometimes therefore called "lost motion" systems. One such lost motion system is described in Hu, U.S. Pat. No. 5,537,976, assigned to the assignee of the present application.

Engine valves are required to open and close very quickly, therefore the valve spring is typically very stiff. When the valve closes, it impacts the valve seat at a velocity that can create forces which may eventually erode the valve or the valve seat or even fracture or break the valve. In mechanical valve actuation systems that use a valve lifter to follow a cam profile, the cam lobe shape provides built-in valve-closing velocity control. In common rail hydraulically actuated valve assemblies, however, there is no cam to self-dampen the closing velocity of an engine valve. Likewise, in hydraulic lost motion systems, a rapid draining of fluid from the hydraulic link between the master and slave pistons may allow an engine valve to "free fall" and seat with an unacceptably high velocity.

As a result, in engine valve and cylinder head design, there is a need to limit valve seating velocities. With hydraulically actuated systems, however, this need for restriction is in conflict with the need for unrestricted valve opening rates. Some attempts have been made to solve the problem by providing separate fill and drain ports. U.S. Pat. No. 5,577,468 discloses a system for limiting valve seating velocity, however, the system disclosed is both costly and inaccurate. Other existing methods for controlling engine valve seating velocity do so for the entire range of valve closing. These methods may cause excessive valve closing variations. Existing systems also fail to accommodate the need for adjustments due to variations in engine valve lash between cylinders.

In addition to excessive valve closing speed, piston overtravel can also cause severe engine damage. It is therefore necessary, to precisely control and limit the return stroke of the engine valve and the actuator piston during engine operation. There are several methods of controlling piston stroke: mechanical stops, mechanisms that cut off the flow of fluid to the piston, and mechanisms that apply high pressure oil to the backside of the piston. Each of these designs, however, have shortcomings. Mechanical stops have durability problems unless seating velocity is controlled. Systems that cut off the oil supply may allow overtravel due to the formation of vapor or the evolution of gas bubbles. Systems that bleed high pressure oil behind the piston place an excessive load on the oil pump.

Accordingly, there is a need for a simple and effective stroke-limiting design that is fail-safe. For mechanical stop methods of stroke-limiting, there is a particular need for a design that reduces the risk of damage to the stops. Furthermore, existing systems do not fill the need for valve seating velocity control which allows free, unrestricted return of the engine valve for a set distance and restricted, controlled return as the valve approaches the valve seat.

The present invention meets the aforementioned needs and provides other benefits as well.

OBJECTS OF THE INVENTION

It is therefore an object of the present invention to provide a hydraulic engine valve control system which allows free valve return over the majority of the valve's return distance, and provides velocity control over a limited range of the valve's travel just prior to seating.

A further object of the present invention is to provide faster, more consistent controlled valve seating.

It is a further object of the present invention to provide a method of free valve return with controlled seating velocity.

Another object of the present invention is to provide an adjustable range over which valve seating velocity is controlled.

It is another object of the present invention to provide an engine valve actuator which allows free, unrestricted opening of an engine valve.

Still another object of the present invention is to provide a means for adjusting, either manually or automatically, an engine valve hydraulic actuation system for variations in engine valve height or lash.

It is also an object of the present invention to provide an improved apparatus for limiting the stroke of the actuator piston.

It is another object of the present invention to provide a piston stroke-limiting means that is fail-safe and low-cost.

It is another object of the present invention to provide slave piston stroke-limiting without a separate stroke-controlling piston.

It is another object of the present invention to provide slave piston stroke-limiting means comprising at least one fixed mechanical stop.

It is another object of the present invention to provide a hydraulic damper that controls the valve seating velocity and thereby reduces damage to the mechanical stop(s).

Additional objects and advantages of the invention are set forth, in part, in the description which follows and, in part, will be apparent to one of ordinary skill in the art from the description and/or from the practice of the invention.

BRIEF SUMMARY OF THE INVENTION

In response to this challenge, applicants have developed an innovative, economical apparatus for controlling the seating velocity of an engine valve. The present invention includes a hydraulic valve actuator for operating an engine valve comprising: an actuator housing; an actuator piston having upper and lower ends, wherein the piston is reciprocally disposed within the housing and is adapted to be moved upward and downward in response to hydraulic pressure; the lower end of the actuator piston is operatively connected to the engine valve so that the engine valve opens when the actuator piston is displaced downward in response to hydraulic pressure upon the upper end, and when the hydraulic pressure is removed from the upper end the actuator piston returns upward and the engine valve shuts; a feed and drain passage in the housing to allow hydraulic fluid to move to and from the upper end of the actuator piston; and a control element disposed within the actuator housing, wherein the control element provides a restriction in hydraulic fluid flow during a portion of the return stroke of the actuator piston thereby limiting the velocity of the actuator piston. The control element may be a disc which includes a central orifice to restrict fluid flow. The disc may include a plurality of orifices to restrict fluid flow.

The actuator piston may include longitudinal and transverse passages which allow fluid to move from the feed and drain passage to the upper end of the piston. The longitudinal passage may include an upper fluid chamber area at the upper end of the actuator piston, and the control element may be disposed within the upper fluid chamber. The actuator piston may further include a protruding exterior annular ring located above the transverse passage and below the upper fluid chamber.

The hydraulic actuator may include a means for adjusting for engine valve lash. The means for adjusting for engine valve lash may comprise: an adjustable sleeve disposed between the actuator piston and the housing and a lash adjustment screw threaded into the housing and contacting the sleeve for adjusting the position of the adjusting sleeve within the housing. Alternatively, the means for adjusting for engine valve lash may comprise: a lash piston disposed reciprocally within the lower end of the actuator piston; a lash compression spring disposed above the lash piston for biasing the lash piston toward the engine valve; and a lash adjustment chamber located within the actuator piston above the lash piston for establishing an hydraulic link between the actuator piston and the lash piston. The actuator piston may further include an internal lower vertical passage for connecting the lash adjustment chamber with the feed and drain passage. The means for adjusting for engine valve lash may further include a check valve between the lower vertical passage and the lash adjustment chamber and wherein the check valve only permits flow into the chamber from the lower vertical passage.

The hydraulic actuator may also comprise: a pin; a pin body; and a piston body; wherein the pin is reciprocally disposed within the pin body and the pin body is disposed within and fixed to the piston body, and the piston body is reciprocally disposed within the housing. The pin body may extend downward from the piston body and be operatively connected to the engine valve. The pin may be biased upward away from the engine valve. The piston body may further include a longitudinal passage and an transverse passage and the pin may extend through the longitudinal passage at the upper end of the piston body. The pin may include a large diameter section so that during the return stroke of the actuator piston the large diameter section of the pin contacts the housing and is forced into the longitudinal passage creating a flow restriction and slowing the velocity of the actuator piston. Alternatively, the pin may include a longitudinal passage and an upper and lower orifice connecting the longitudinal passage to the exterior of the pin. The pin may also include a large diameter section so that during the return stroke of the actuator piston the large diameter section of the pin contacts the housing and is forced into the longitudinal passage substantially cutting off the flow of hydraulic fluid between the piston body and the pin so that fluid flows through the upper and lower orifices thereby creating a flow restriction and slowing the velocity of the actuator piston.

In an alternative embodiment the hydraulic actuator of the present invention the control element is a seating piston reciprocally disposed partially within the longitudinal passage at the upper end of the actuator piston. The seating piston may include a vertical passage through which fluid flows from the upper fluid chamber to the feed and drain passage. The actuator may further include a spring disposed in the longitudinal passage below the seating piston, wherein the spring biases the seating piston upward away from the engine valve. The seating piston may include a notch at its upper end so that during the return stroke of the actuator piston when the seating piston contacts the housing and is forced downward further into the longitudinal passage a restricted flow path is established from the upper fluid chamber through the notch and the vertical passage to the feed and drain passage.

A further embodiment of the present invention includes a hydraulic valve actuator for operating an engine valve comprising: an actuator housing; an actuator piston having upper and lower ends, wherein the piston is reciprocally disposed within the housing and is adapted to be moved upward and downward in response to hydraulic pressure; the lower end of the actuator piston is operatively connected to the engine valve so that the engine valve opens when the actuator piston is displaced downward in response to hydraulic pressure upon the upper end, and when the hydraulic pressure is removed from the upper end the actuator piston returns upward and the engine valve shuts; a feed and drain passage in the housing to allow hydraulic fluid to move to and from the upper end of the actuator piston; and a snubber plunger disposed within the actuator housing above the actuator piston, wherein the snubber plunger provides a restriction in hydraulic fluid flow during a portion of the return stroke of the actuator piston thereby limiting the velocity of the actuator piston. The snubber plunger may be reciprocally disposed within a plunger housing and may be biased downward toward the actuator piston by a spring. The actuator may further include a plunger chamber located above the snubber plunger. The snubber plunger may also include a vertical passage providing a flow path from the plunger chamber through the snubber plunger. The snubber plunger may be disposed within the plunger housing so that during the upward motion of the snubber plunger fluid may flow out of the plunger chamber through the clearance between the snubber plunger and the plunger housing. The snubber plunger may include a vertical passage and a horizontal passage providing a flow path from the plunger chamber through the snubber plunger.

The present invention may also be a hydraulic valve actuator for operating an engine valve comprising: an actuator housing having a vertically aligned central bore; an actuator piston having upper and lower ends, wherein the piston is reciprocally disposed within the central bore and is adapted to be moved upward and downward in response to hydraulic pressure; the lower end of the actuator piston is operatively connected to the engine valve so that the engine valve opens when the actuator piston is displaced downward in response to hydraulic pressure upon the upper end, and when the hydraulic pressure is removed from the upper end the actuator piston returns upward and the engine valve shuts; an end cap located above the actuator piston position to seal off the upper end of the central bore and retain the actuator piston; a feed and drain passage in the housing to allow hydraulic fluid to move to and from the upper end of the actuator piston; and a dampening assembly comprising a cavity on the downward side of the end cap, wherein the cavity is capable of receiving the upper end of the actuator piston so that during the return stroke of the actuator piston hydraulic fluid is trapped in the cavity forming a cushion and reducing the velocity of the actuator piston. The upper end of the actuator piston may include a projection section capable of fitting within the cavity. The lower end of the central bore may include a reduced diameter section and the actuator piston includes a projection capable of fitting within the reduced diameter section of the central bore so that during the opening of the engine valve a cushion is formed which limits the movement of the engine valve. The actuator may further include a means for adjusting the actuator for variations in engine valve lash. The means for adjusting may comprise: a vertically aligned central passage located within in the actuator piston; an adjustable pin threaded into the central passage projecting downward from the actuator piston to operatively connect with the engine valve; and a locking pin located in the central passage above the adjustable pin to secure the adjustable pin in position.

It is to be understood that both the foregoing general description and the following detailed description are exemplary and explanatory only, and are not restrictive of the invention as claimed. The accompanying drawings, which are incorporated herein by reference, and which constitute a part of the specification, illustrate certain embodiments of the invention, and together with the detailed description serve to explain the principles of the present invention.

DETAILED DESCRIPTION OF THE INVENTION

Figure 1:
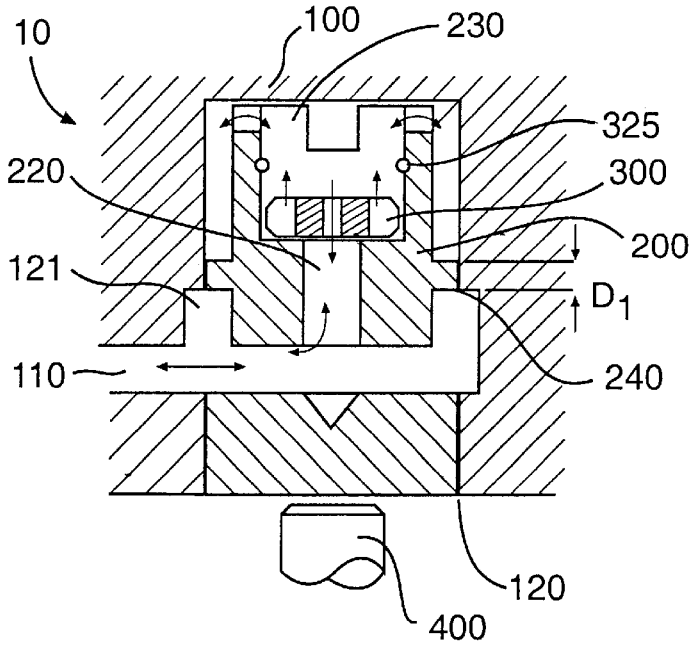
FIG. 1 is a is a cross-sectional view of a valve actuation system according to the present invention with the engine valve in its seated position.

An embodiment of the hydraulic actuator 10 of the present invention is shown in FIG. 1. The hydraulic actuator 10 controls the engine valve 400. The actuator 10 of FIG. 1 includes a housing 100, an actuator piston 200, and a control element 300. The engine valve 400 is typically spring loaded toward a valve closed position and opened against the spring bias by hydraulic pressure. When the actuator piston 200 is forced downward by oil pressure, the biasing of the valve spring (not shown) is overcome and the engine valve 400 opens. When the oil pressure is removed, the actuator piston 200 returns and the engine valve 400 moves upward and closes.

The hydraulic actuator described in this application may function with a variety of types of hydraulic valve actuation systems. In one embodiment the actuator 10 may be part of a "lost motion" system. The actuator piston 200 may be connected through passageway 110 via a hydraulic link to a master piston (not shown). The master piston reciprocates within a cylinder in response to a rotating cam. The motion generated by the cam profile causes corresponding motion, via the hydraulic link, of actuator piston 200. Hydraulic fluid may be drained and added to the hydraulic link between the master piston and actuator piston 200 in order to achieve a variable timing effect.

Alternatively, actuator 10 may be connected via passageway 110 to a source of high pressure hydraulic fluid controlled by a solenoid control valve. This type of system is commonly referred to as a "common rail" system.

The engine valve is a poppet type well known in the art. The engine valve may be an intake or exhaust valve of conventional construction. The engine valve generally includes a valve head, valve stem, and valve spring. The valve spring is preferably a coil spring disposed about stem of the engine valve. Valve spring biases the engine valve in an upward direction to seat against its valve seat. For simplicity, the engine valve is shown in the figures of this application as contacting the actuator 10 directly. Alternatively, the engine valve may be connected to a valve stem and stem shank, and the stem shank may contact the actuator. However, any arrangement in which the engine valve is operatively connected to the actuator piston 200 is within the scope of the invention.

The actuator piston 200 may have a generally cylindrical body which is appropriately sized for reciprocation within bore 120. The actuator 10 and its components are preferably formed from metallic materials, but may also be made of any of a variety of high-strength plastics, composite materials, or any suitable material.

The housing 100 includes a fluid feed and drain passage 110. The passage 110 allows hydraulic fluid to pass to and from the actuator 10. The housing further includes a housing bore 120 for receiving the actuator piston 200. The bore 120 includes an area 121 with an increased diameter in the vicinity of the passage 110.

The actuator piston 200 is slidably disposed within the bore 120 of the actuator housing 100. The actuator piston 200 and housing 100 form an upper fluid chamber 230. The piston 200 further includes a radial, transverse or horizontal passage 210 and a longitudinal or vertical passage 220. The vertical passage 220 is disposed along the longitudinal axis of the actuator piston 200. The horizontal and vertical passages provide a flow path for fluid from the feed and drain passage 110 to the upper fluid chamber 230. The actuator piston 200 further includes an annular ring 240 located on the exterior of the piston 200. The height of the annular ring 240 is designated by the letter "$D_1$," in FIG. 1. The annular ring 240 is positioned on the actuator piston 200 so that with the valve 400 in the closed ("at rest") position, the top of the annular ring 240 is above the area 121 of increased diameter in the housing bore 120.

The control element disc 300 is slidably located within the upper chamber 230. The control disc 300 may include side orifices 320 and a central orifice 310. Upward travel of the control disc 300 may be limited by a retaining ring 325.

Figures 5, 6, 7:
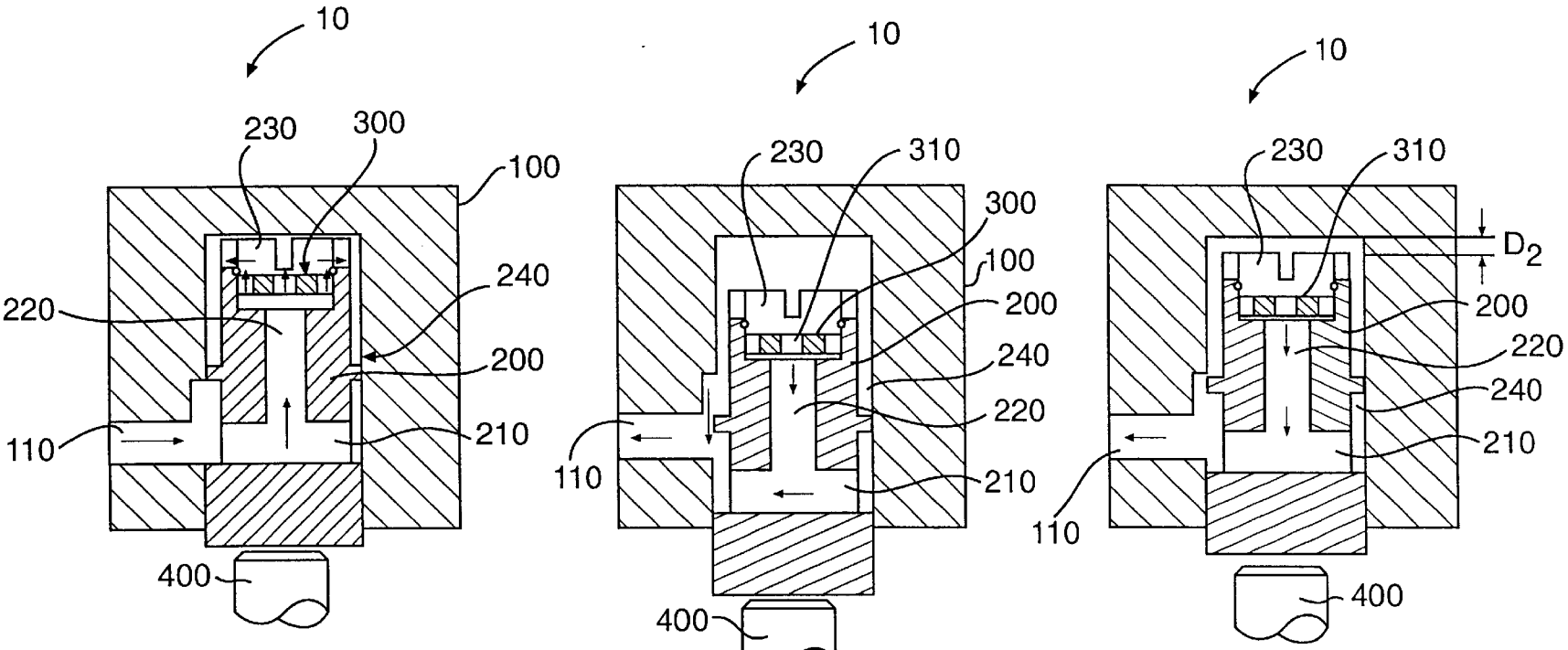
FIG. 5 is a cross-sectional view of the embodiment of the present invention shown in FIG. 1 with the engine valve in the at rest position.
FIG. 6 is a cross-sectional view of the embodiment of the present invention shown in FIG. 1 during free return of the engine valve.
FIG. 7 is a cross sectional view of the embodiment of the present invention shown in FIG. 1 during snubbed return of the engine valve.

The operation of the actuator 10 will now be described. FIGS. 1 and 5 show the engine valve 400 in the seated position and the actuator piston 200 at rest in the housing bore 120. FIG. 5 discloses the beginning of the engine valve stroking process. Oil from passage 110 flows into the horizontal passage 210 of the actuator piston 200. The oil flows through the vertical passage 220 and into the upper chamber 230. Initially, the oil flows through the central orifice 310 in the control disc 300, the flow of oil pushes the control disc 300 up allowing the free flow of oil through both the center 310 and side orifices 320. As oil fills the upper chamber 230, the actuator piston 200 is forced downward, overcoming the biasing of the valve spring and opening the valve 400.

Figure 2:
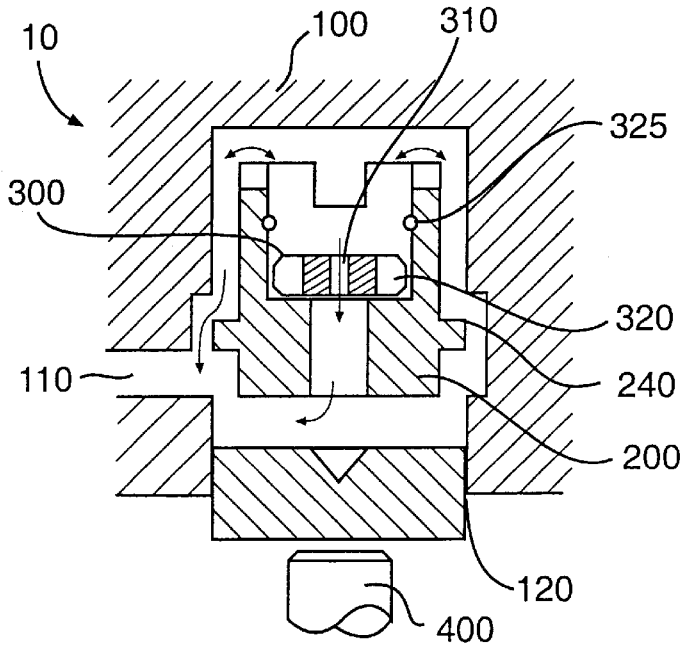
FIG. 2 is a is a cross-sectional view of the embodiment shown in FIG. 1 during free return of the engine valve.

At the appropriate time, the oil pressure within the actuator 10 and actuator piston 200 is vented through passage 110 allowing the valve spring to force the valve 400 shut. The seating velocity of the engine valve is proportional to the rate of return of the actuator piston 200. Initially, the seating velocity of the valve 400 is not limited. FIGS. 2 and 6 show the initial free return of the actuator piston 200 and the engine valve 400. The flow of oil out of the actuator piston 200 toward the passage 110 causes a flow reversal within the upper chamber 230. The control disc 300 is forced downward, blocking the side orifices 320. The center orifice 310 is calibrated to correspond to the appropriate valve seating velocity. However, during the free return period shown in FIGS. 2 and 6, valve seating velocity is not limited by the central orifice 310 since oil may flow freely around the outside of the piston until the annular ring 240 reaches the housing 100 thereby blocking flow around the actuator piston 200.

FIG. 7 discloses the snubbed return of the actuator piston 200. During the snubbed return period, valve seating velocity is limited because oil flow past the piston 200 is blocked by the annular ring 240. When the annular ring 240 has blocked the return flow of oil around the outside of the piston, oil must flow through the calibrated central orifice 310 in disc 300. During this period, the actuator piston 200 returns at a controlled rate until the valve 400 seats. The limited range of valve seating is determined by the distance from the top of the piston 200 to the top of the bore 120 after the annular ring 240 has blocked external flow. In the embodiment shown in FIG. 7, this distance is $D_2$.

Figure 8:
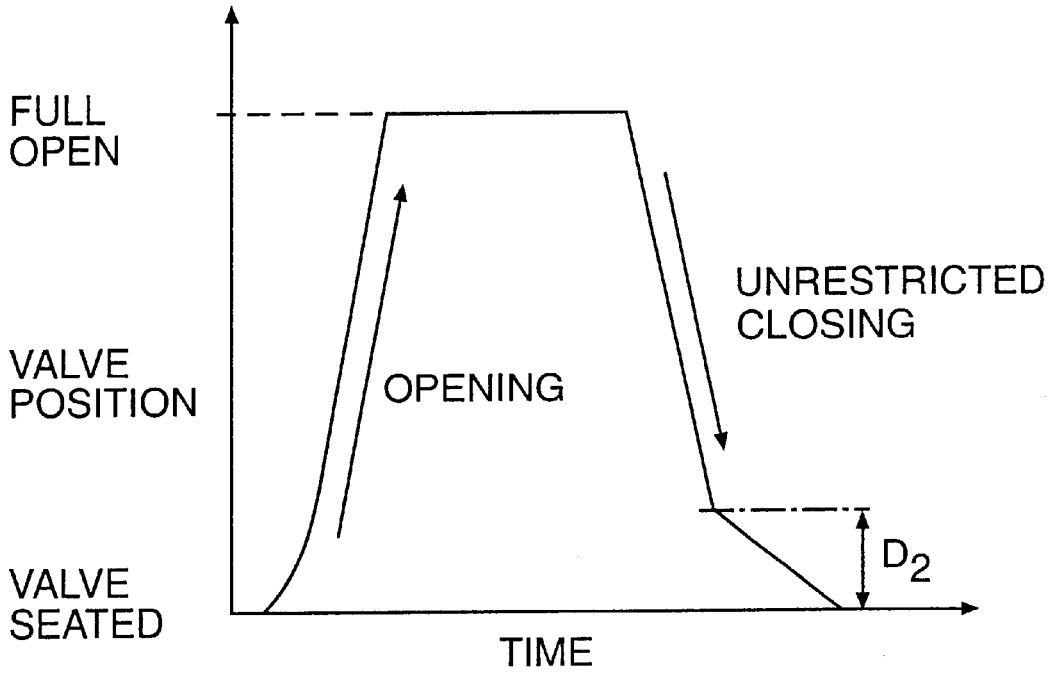
FIG. 8 is a graph of engine valve position versus time resulting from operation according to the present invention.

FIG. 8 discloses a graph of engine valve position versus time. The slope of the line corresponds to the valve velocity. For the limited range corresponding to distance $D_2$, just prior to valve seating, the reduced valve seating velocity is apparent by the change in the slope of the curve.

Figure 3:
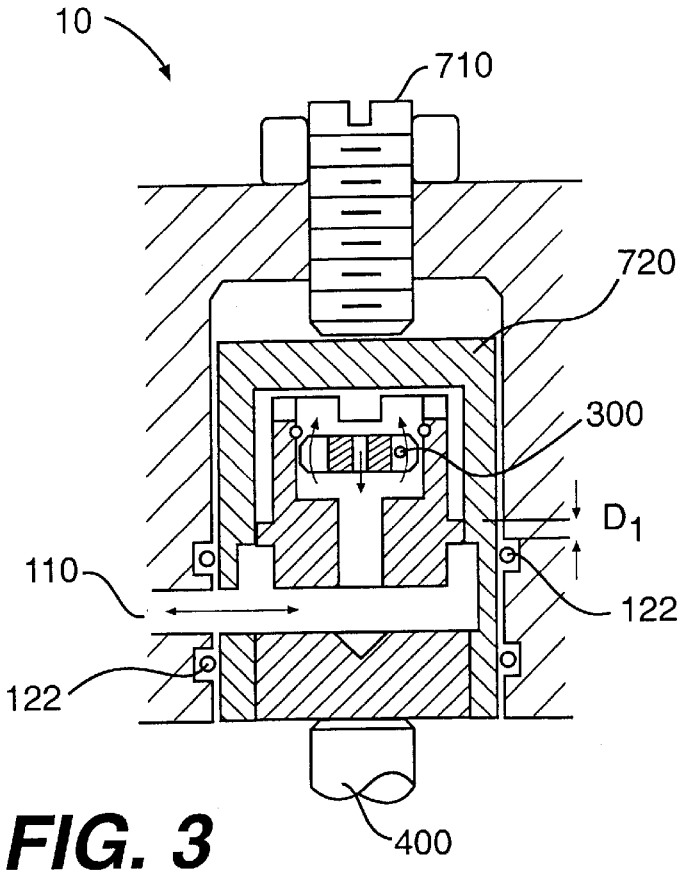
FIG. 3 is a cross-sectional view of an embodiment of the present invention including a lash adjustment means.

FIG. 3 discloses an alternative embodiment of the present invention, which includes a lash adjustment means. The lash adjustment means includes an adjustable sleeve 720, located between the housing 100 and the actuator piston 200. The position of sleeve 720 within the housing 100 is changed by adjusting a lash adjustment screw 710. The sleeve 720 is positioned so that the distance in which valve seating velocity is reduced corresponds to the distance just prior to the seating of engine valve 400. The present invention may also include sealing rings 122 disposed between the housing 100 and the adjustable sleeve 720.

Figure 4:
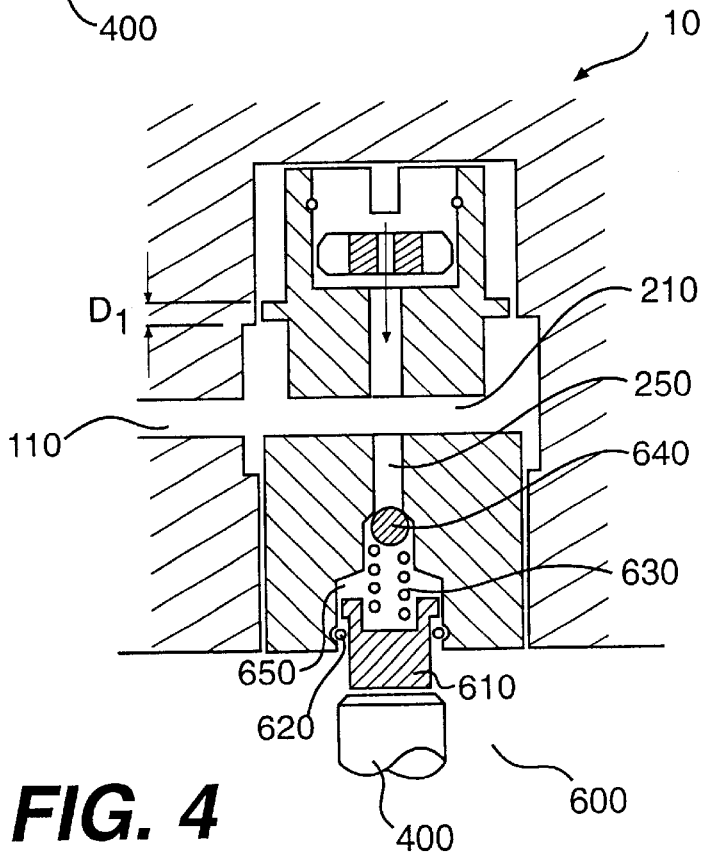
FIG. 4 is a cross-sectional view of an embodiment of the present invention including an automatic lash adjustment means.

FIG. 4 discloses an alternative embodiment of a lash adjustment means 600. The actuator piston 200 shown in FIG. 4 includes a lower passage 250 connecting the horizontal passage 210 with the lash adjustment means 600. The lash adjustment means 600 may include a ball check valve 640; a lash compression spring 630; a lash piston 610; and a lash piston retaining ring 620. The lash adjustment means functions to adjust the lash automatically while keeping the distance $D_2$ constant.

The lash is adjusted during the initial fill of fluid into the piston 200. When fluid enters the actuator piston 200, it flows into the lower passage 250 and unseats the ball check valve 640. Fluid fills the lash adjustment chamber 650 taking up the lash between the lash piston 610 and the valve 400. Once chamber 650 is full, ball check valve 640 seats due to the biasing of spring 630 creating a hydraulic link between the lash piston 610 and the actuator piston 200.

Figure 9:
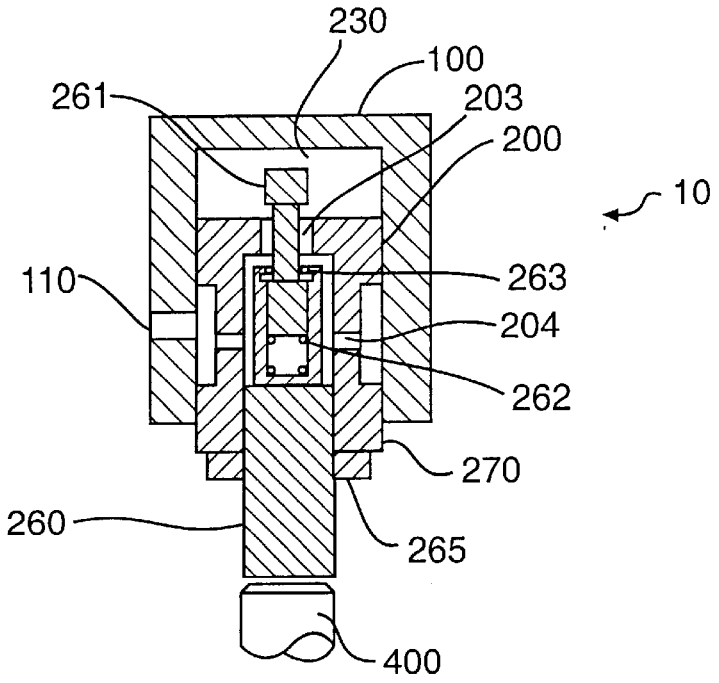
FIG. 9 is a cross-sectional view of an alternative embodiment of the present invention which includes a valve seating pin within the actuator piston.

A further embodiment of the hydraulic actuator 10 of the present invention is shown in FIG. 9. The actuator 10 shown in FIG. 9, includes a housing 100 and an actuator piston 200. The actuator piston 200 is comprised of an actuator piston body 270 and a valve seating pin body 260. The valve seating pin body 260 is threaded into the actuator piston body 270 which in turn is slidably disposed within the housing 100. The valve seating pin body 260 extends outward from the actuator piston body 270 toward the engine valve 400. The embodiment shown in FIG. 10 further includes a valve seating pin 261 slidably disposed within valve seating pin body 260. The valve seating pin 261 extends away from the engine valve 400 and into the housing 100 passing through an opening 203 in the actuator piston body 270. The valve seating pin 261 is biased outward by a spring 262 located within the valve seating pin body 260. The valve seating pin 261 is retained within the valve seating pin body 260 by a snap ring 263. Fluid passes back and forth from the upper fluid chamber 230 to the high pressure passage 110 through opening 203 and a passage 204 located in the side of the actuator piston body 270.

FIG. 9 shows the present invention with the engine valve 400 open and the actuator piston 200 extended in its downward position. When it is desired to shut the engine valve 400, the high pressure fluid in passage 110 is vented. Actuator piston 200 returns freely until the valve seating pin 261 contacts the housing 100. As the actuator piston 200 continues to rise, valve seating pin 261 is forced into opening 203 in the actuator piston body 270. When valve seating pin 261 resides within opening 203, the effective size of opening 203 is reduced, causing a reduction in the flow of fluid escaping from upper fluid chamber 230. The reduced flow rate of fluid will continue until the valve 400 closes. The embodiment shown in FIG. 9 may be further modified to include a tapered valve seating pin 261. Tapering the valve seating pin 261 imposes a variable restriction during the controlled range of valve seating and, as a result, variable valve seating velocity.

Figure 10:
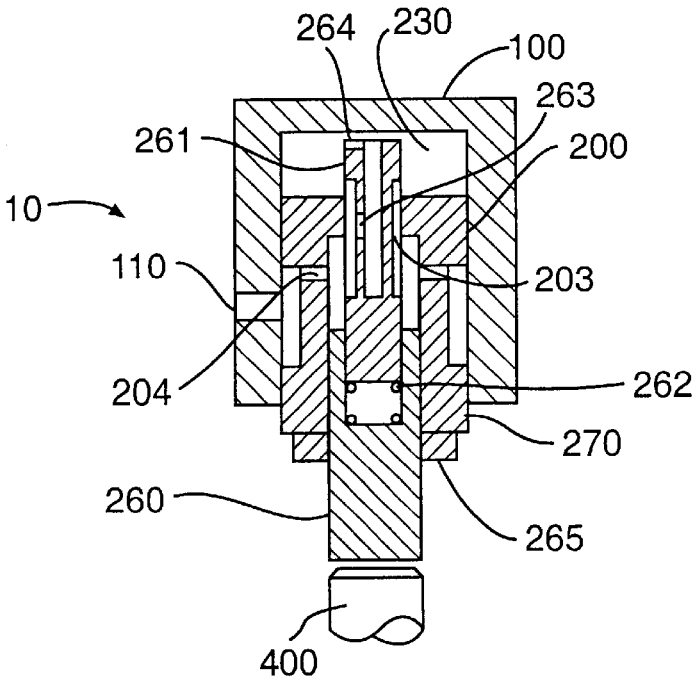
FIG. 10 is a cross-sectional view of a further alternative embodiment of the present invention which includes a valve seating pin within the actuator piston.

FIG. 10 shows a further embodiment of the present invention. The device shown in FIG. 10 functions in a similar manner to the device shown in FIG. 9 described above. Unlike the pin shown in FIG. 9, the valve seating pin 261 disclosed in FIG. 10 includes a notch 264 and a side orifice 263. During valve seating, the high pressure fluid in passage 110 is vented and actuator piston 200 returns freely as fluid escapes from chamber 230 through passage 203. As the actuator piston 200 continues to rise, valve seating pin 261 contacts the housing 100 and is forced into opening 203 in the actuator piston body 270. Flow through passage 203 is substantially blocked causing the flow of fluid out of the upper fluid chamber 230 to pass through seating restriction 264 and into the interior of the pin. Fluid then escapes through side orifice 263 and out of the actuator piston through passage 204. The tortuous flow path created by the notch 264 and side orifice 263 reduces the flow rate of the escaping fluid and limits the valve seating velocity correspondingly. The devices shown in FIGS. 9 and 10 both include a lock nut 265 which is used to adjust the relative position of the actuator piston body 270 and the valve seating pin body 260 to account for differences between the seating lengths of different engine valves. The embodiments of the present invention shown in FIGS. 9 and 10 may also include either of the lash adjustment devices disclosed in FIGS. 3 and 4.

Figures 11, 12, 13:
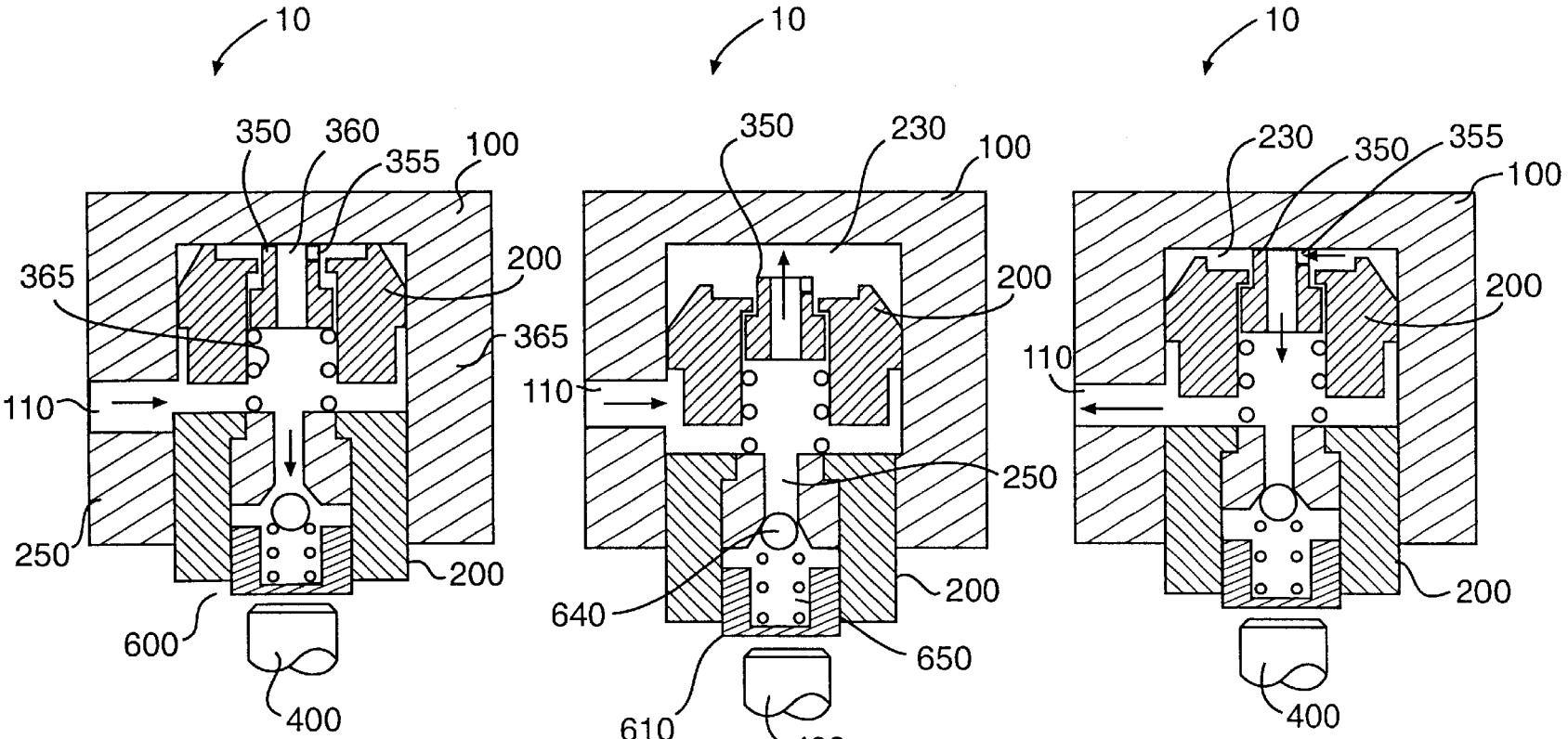
FIG. 11 is a cross-sectional view of an embodiment of the present invention with a valve seating piston and an automatic lash adjustment means.
FIG. 12 is a cross-sectional view of the embodiment of the present invention shown in FIG. 11 during filling of the hydraulic actuator
FIG. 13 is a cross-sectional view of the embodiment of the present invention shown in FIG. 11 during snubbed return of the engine valve.

FIGS. 11, 12 and 13 disclose a similar embodiment of the present invention during various stages of operation. The actuator shown in FIG. 11 includes an actuator piston 200 and a valve seating piston 350. The valve seating piston 350 includes a central passage 360 and a notch 355. The valve seating piston 350 is biased upwardly by valve seating pin spring 365. The device shown in FIG. 11 further includes a lash adjustment means 600 similar to that shown in FIG. 4 described above.

FIG. 11 shows actuator 10 with the valve 400 closed. High pressure fluid passes through passage 110 and into the actuator piston 200. The fluid will pass upward through passage 360 and through notch 355 into the upper fluid chamber 230. The incoming fluid fills the chamber 230 and forces actuator piston 200 downward. The downward travel of actuator piston 200 overcomes the spring biasing and opens the valve 400.

FIG. 12 shows the flow of high pressure fluid through the upper passage 360 within the valve seating piston 350. Initially, fluid also flows toward lash adjustment means 600. Fluid flows into the lower passage 250 and unseats the ball check valve 640. Fluid fills the lash adjustment chamber 650 taking up the lash between the lash piston 610 and the valve 400. Once chamber 650 is full, ball check valve 640 seats, and a hydraulic link is established between the lash piston 610 and the valve 400.

FIG. 13 discloses the actuator 10 during the valve seating stroke. When the valve 400 is to be closed, high pressure fluid in the actuator 10 is vented through passage 110. The actuator piston 200 begins its free return until such time as the valve seating piston 350 contacts the housing 100. After valve seating piston 350 contacts the housing 100, the flow of oil is limited by the notch 355. Therefore, valve seating velocity is correspondingly limited until the valve closes.

Figures 14, 15, 16:
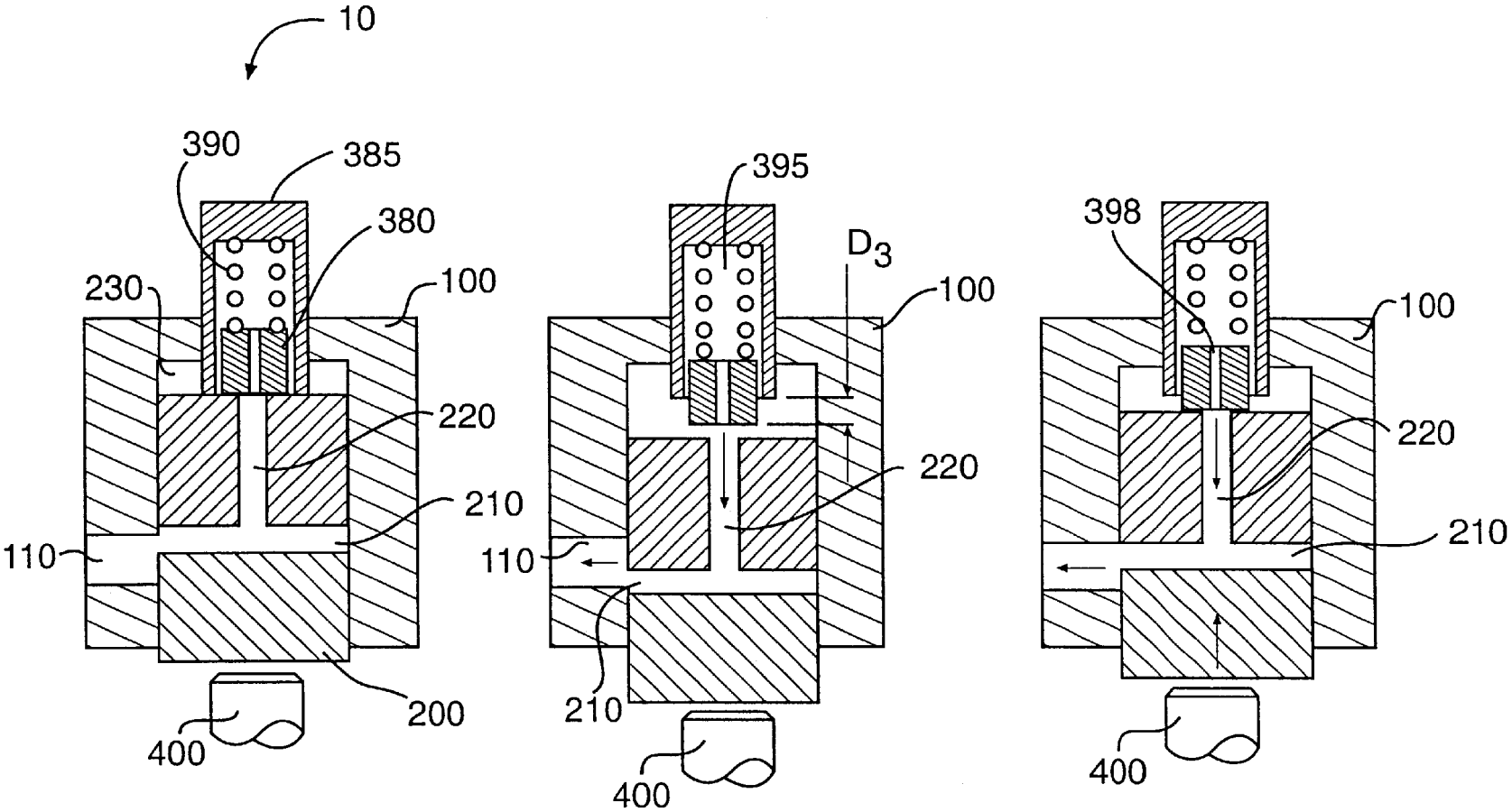
FIG. 14 is a cross-sectional view of an embodiment of the present invention in which the plunger and the actuator piston have internal passageways, and the engine valve in the at rest position.
FIG. 15 is a cross-sectional view of the embodiment of the invention shown in FIG. 14 during free return of the engine valve.
FIG. 16 is a cross-sectional view of the embodiment of the invention shown in FIG. 14 during snubbed return of the engine valve.

A further embodiment of the present invention is disclosed in FIGS. 14–16. FIGS. 14–16 disclose a hydraulic valve actuator comprising a housing 100; an actuator piston 200, a snubber plunger 380, a plunger housing 385 and plunger return spring 390. The actuator operates to force the actuator piston 200 downward in order to actuate engine valve 400. Housing 100 includes a passage 110 to allow hydraulic fluid to move to and from the actuator 10.

Plunger housing 385 is a generally cylindrical, hollow body disposed in and projecting through housing 100. Plunger housing 385 is rigidly mounted to the top of housing 100. Preferably the plunger housing 385 is threaded into housing 100 in order to provide a tight connection. Plunger housing 385 includes a chamber 395 in which the plunger 380 and plunger return spring 390 are located. Plunger housing 385 may further comprise a stop (not shown) which projects into chamber 395 and retains snubber plunger 380 in plunger housing 385. The use of a threaded connection between plunger housing 385 and the housing 100, allows the position of the plunger housing 385 relative to the housing 100 to be varied. The plunger housing 385 may be manually rotated to place it in the desired position. Varying the vertical position of plunger housing 385 varies the vertical position of snubber plunger 380 and as a result provides a means for adjusting the range during which the engine valve 400 seating velocity is controlled. Plunger return spring 390 acts to bias snubber plunger 380 in a downward direction.

Snubber plunger 380 may be a generally cylindrical body. Snubber plunger 380 is biased downward against stop by plunger return spring 390. When snubber plunger 380 is fully displaced downward, it projects out from the snubber housing 385 a distance $D_3$. Snubber plunger 380 includes an internal passage 398. Passage 398 provides a controlled fluid flow path between the plunger chamber 395 and the hydraulic fluid passage 110.

The operation of the embodiment disclosed in FIGS. 14–16 will now be described. FIG. 14 shows actuator piston 200 at rest with no hydraulic pressure in chamber 230 applied against top surface of actuator piston 200. The engine valve is shut. Actuator piston 200 is abutting the bottom of snubber plunger 380. When actuator piston 200 is at its minimum stroke, snubber plunger 380 is at its minimum stroke. Actuator piston 200 forces snubber plunger 380 into the snubber housing 385 against the bias of plunger return spring 390. The relative position of actuator piston 200 within housing 100 may be adjusted by rotation of the threaded plunger housing 385. In this way, the actuator 10 may be adjusted for variations in engine valve lash. In addition, the actuator shown in FIGS. 15–16 may be modified to accommodate a lash adjustment means as disclosed in FIG. 4.

Referring again to FIG. 14, in order to actuate the engine valve, hydraulic fluid under pressure may be admitted to chamber 230 through passageway 110. The hydraulic fluid acts against the top surface of actuator piston 200 to move actuator piston 200 downward. Actuator piston 200 acts against the engine valve 400 forcing the engine valve downward against the bias of valve spring opening the engine valve.

As actuator piston 200 moves downward to actuate the engine valve, snubber plunger 380 follows actuator piston 200 downward under the bias of plunger return spring until the downward motion of snubber plunger 380 is arrested by a stop in plunger housing 385. The snubber plunger 380 is displaced outward from snubber housing 385 a distance $D_3$. Initially, hydraulic fluid enters chamber 230 through the clearance gap between the snubber plunger 380 and plunger housing 385. Once the downward motion of snubber plunger 380 has been arrested by the mechanical stop, actuator piston 200 separates from snubber plunger 380 as actuator piston 200 continues to stroke downward under the force of the hydraulic fluid entering chamber 230. During valve actuation, valve opening is not restricted. Snubber plunger 380 acts as a check valve, allowing unrestricted flow from passage 110 to chamber 230.

When it is desired to close the engine valve, the valve actuation system releases the hydraulic fluid from chamber 230 through passage 110. When the bias of valve spring overcomes the downward force of actuator piston 200, actuator piston 200 begins to move upward as the engine valve closes. Actuator piston 200 is then in a condition of "free return," as depicted in FIG. 15.

Referring to FIG. 16, as the engine valve moves toward a closed position and begins to approach the valve seat, actuator piston 200 eventually comes within a distance $D_3$ of the plunger housing and contacts the bottom of snubber plunger 380. From that point on, until the engine valve is seated, actuator piston 200 and the engine valve are in a condition of "snubbed return," as depicted in FIG. 16. in snubbed return, the upward speed of actuator piston 200 is limited by the snubber plunger 380 and the size of passage 398.

During snubbed return, the upward motion of snubber plunger 380 displaces hydraulic fluid from chambers 395 and 230. The hydraulic fluid exits chamber 395 through passage 398. During snubbed return, the upward speed of snubber plunger 380 and the engine valve is limited to the rate at which hydraulic fluid is discharged from chamber 395 and 230 in plunger housing 390. The snubbing of actuator piston 200 reduces the seating velocity of engine valve 400 to a desired value.

Actuator 10 shown in FIGS. 14–16, may be adjusted for lash by adjusting the position of plunger housing 385 in housing 100. As discussed above, the position of plunger housing 385 may be adjusted by manually rotating the threaded plunger housing 385 in the housing 100. The vertical position of snubber plunger 380 relative to plunger housing 385 ($D_3$), may also be varied to adjust the snubbed distance during valve seating. When the engine valve is closed, actuator piston 200 will again be at its at rest position, as shown in FIG. 14. The actuation cycle of the engine valve may then begin anew.

Figure 19:
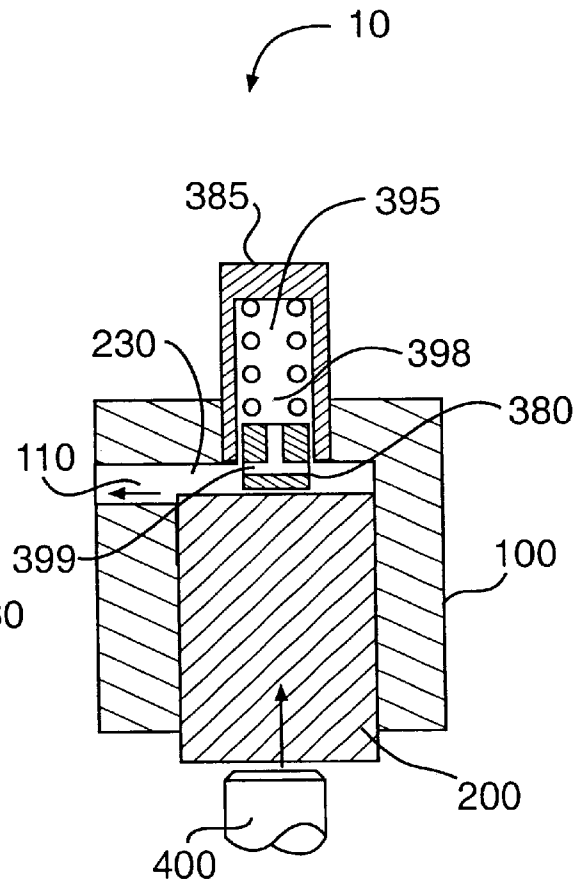
FIG. 19 is a cross-sectional view of the embodiment of the invention shown in FIG. 17 during snubbed return of the engine valve.
Figure 18:
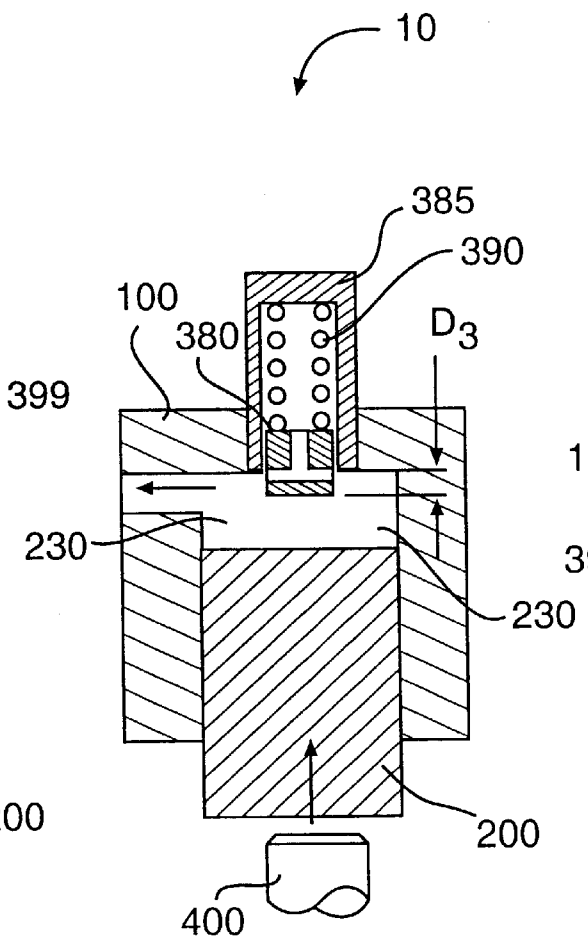
FIG. 18 is a cross-sectional view of the embodiment of the invention shown in FIG. 17 during free return of the engine valve.
Figure 17:
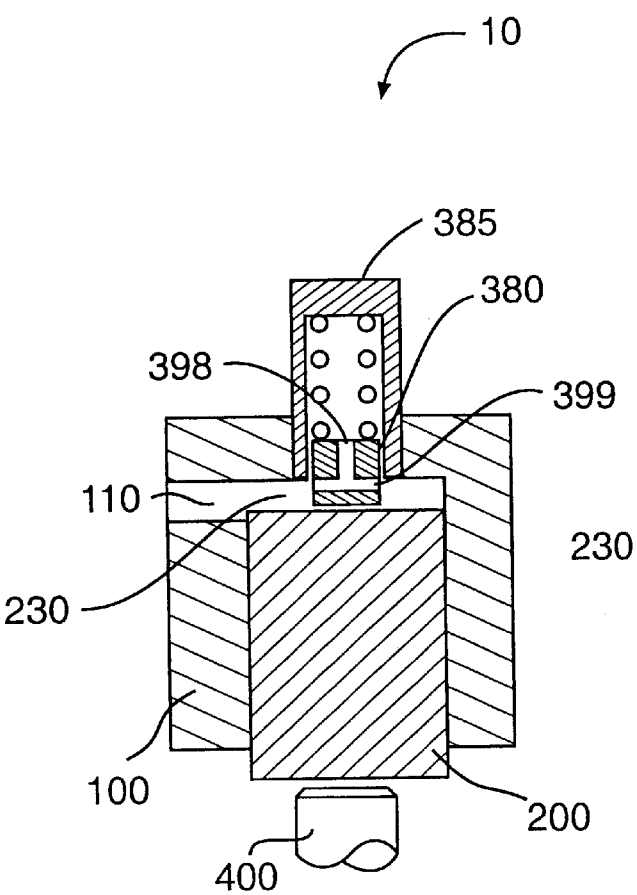
FIG. 17 is a cross-sectional view of an alternative embodiment of the invention having a plunger with internal passageways and a solid actuator piston, with the engine valve in the at rest position.

Referring now to FIGS. 17–19, in an alternate embodiment of the invention, snubber plunger 380 is provided with vertical internal passageway 398 and horizontal internal passageway 399. Vertical internal passageway 398 in conjunction with horizontal internal passageway 390 provide a fluid communication path between chamber 395 in plunger housing 385, and chamber 230. In this embodiment of the invention, valve seating velocity is controlled by the size of passages 398 and 399.

The functioning of the embodiment disclosed in FIGS. 17–19 is similar to that described above with reference to FIGS. 14–16. In this embodiment, however, the seating velocity of engine valve 400, is limited by the flow rate of hydraulic fluid out of chamber 395 through vertical internal passageway 398 and horizontal internal passageway 399 as snubber plunger 380 moves upward. This is in contrast to the embodiment shown in FIG. 16 in which seating velocity of engine valve 400 is limited by the flow rate of hydraulic fluid out of chambers 395 and 230 through passageway 398.

The seating velocity of the engine valve is determined by the dimensions of vertical internal passageway 398 and horizontal internal passageway 399 in snubber plunger 380. As described in reference to the embodiment of the invention shown in FIGS. 14–16, the actuator 10 may be adjusted for lash by rotating the threaded plunger housing 385 in housing 100.

Figure 22:
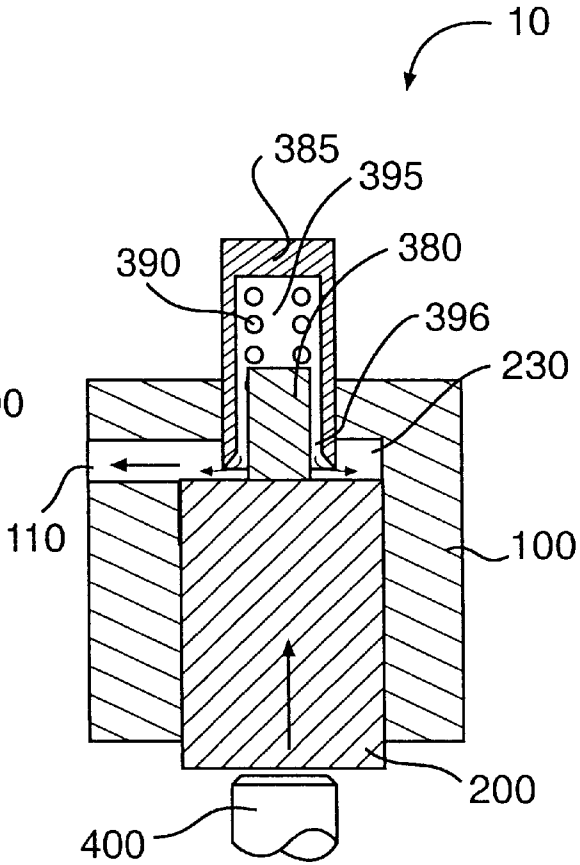
FIG. 22 is a cross-sectional view of the embodiment of the invention shown in FIG. 21 during snubbed return of the engine valve.
Figure 21:
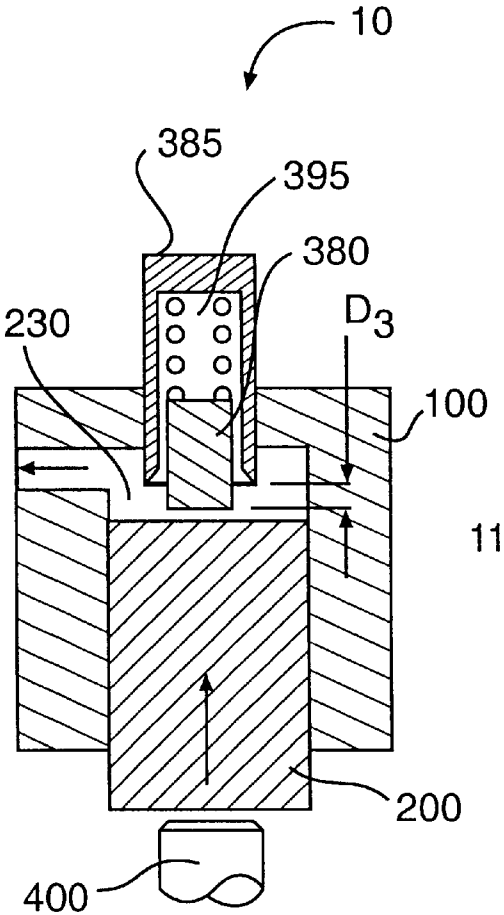
FIG. 21 is a cross-sectional view of the embodiment of the invention shown in FIG. 20 during free return of the engine valve.
Figure 20:
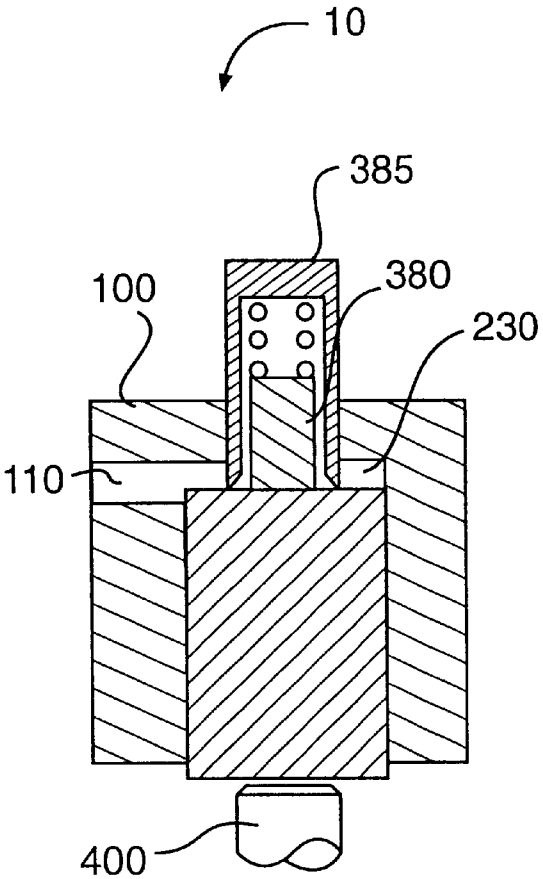
FIG. 20 is a cross-sectional view of an alternate embodiment of the invention having a solid plunger and a solid actuator piston, with the engine valve in the at rest position.

Referring now to FIGS. 20–22, in another alternate embodiment of the invention, a solid snubber plunger 380 is provided with no internal passageways. Similar to FIGS. 17–19, actuator piston 200 is also a solid piece. The hydraulic fluid flows from chamber 395 through clearances 396 around snubber plunger 380 as shown in FIG. 22. Snubber housing 385 has a chambered edge in chamber 230 in order to allow smoother flow of hydraulic fluid out of chamber 395.

The function of the embodiment of the invention shown in FIGS. 20–22 is similar to the embodiment of the invention described above in reference to FIGS. 17–19 and 14–16. In this embodiment, however, the seating velocity of the engine valve is controlled by the discharge rate of hydraulic fluid through the clearance 396 between snubber housing 395 and snubber plunger 380.

Figures 23, 24, 25:
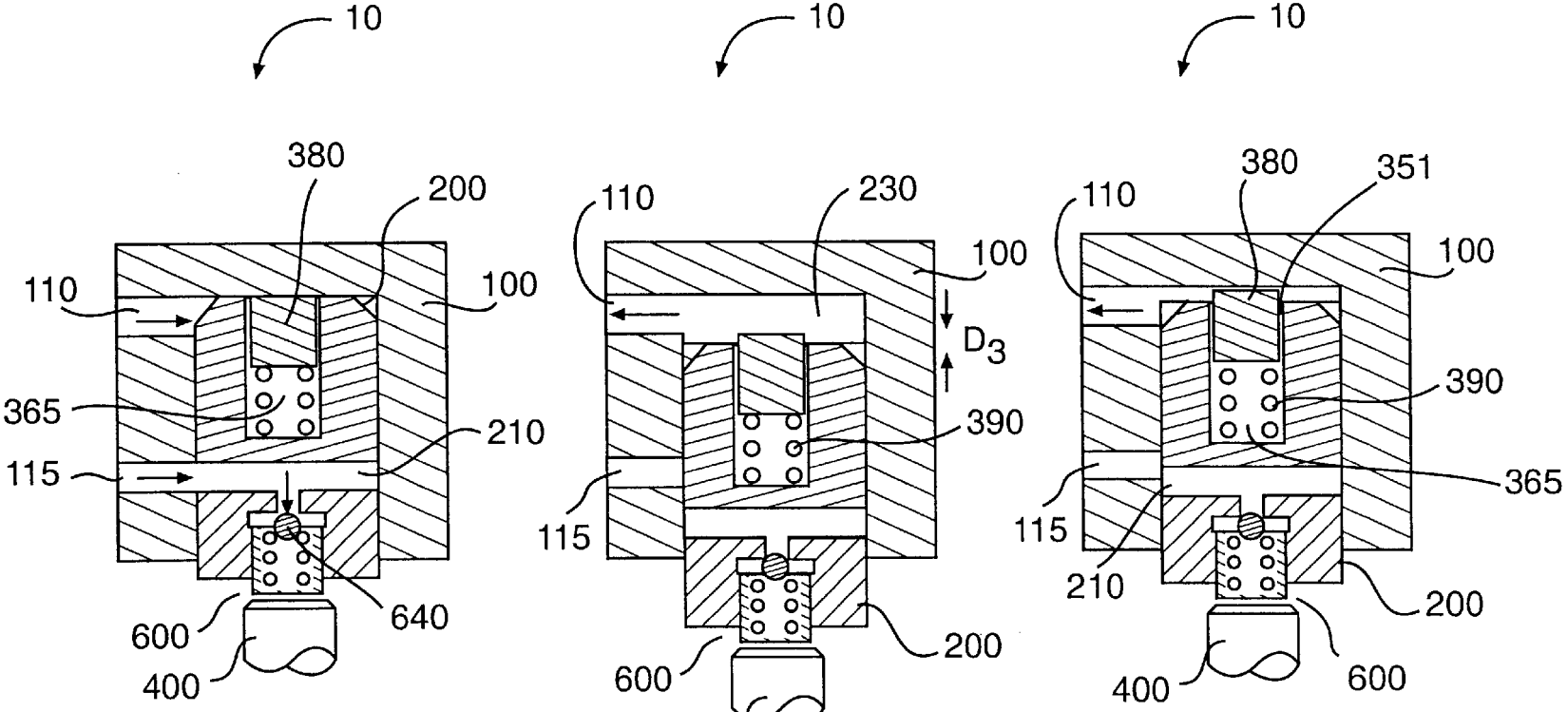
FIG. 23 is a cross-sectional view of an alternate embodiment of the invention which includes automatic lash adjustment with the engine valve in the at rest position.
FIG. 24 is a cross-sectional view of the embodiment of the invention shown in FIG. 23 during free return of the engine valve.
FIG. 25 is a cross-sectional view of the embodiment of the invention shown in FIG. 23 during snubbed return of the engine valve.

Reference is now made to FIGS. 23–25 which disclose another embodiment of the invention. In this embodiment, actuator piston 200 is preferably a cylindrical annular member with chamber 365 formed therein. Snubber plunger 380 is slidably disposed in actuator piston 200. Plunger return spring 390 is disposed with actuator piston 200 and biases snubber plunger 380 upward out of actuator piston 200. Actuator piston 200 may further include a lash adjustment means 600. Lash adjustment means 600 is configured as disclosed in FIGS. 11–13 and functions as described above.

Actuator housing 100 is provided with passageway 110 which, as in the embodiments previously described, provides fluid communication path to a hydraulic fluid source which is part of a hydraulic valve actuation circuit.

Actuator housing 100 further includes passageway 115 which supplies fluid to lash adjustment means 600. Passageway 115 is preferably connected to a supply of low pressure fluid. For example, passageway 115 may be connected to engine supply oil at bearing lubrication pressure. Alternatively, passageway 115 may be connected to other supplies of relatively low pressure hydraulic fluid. Actuator piston 200 is provided with a internal radial, horizontal or transverse passage 210. Passage 210 provides a fluid communication path between passageway 115 and lash adjustment means 600.

Snubber plunger 380 is preferably biased upward against a stop (not shown) by plunger return spring 390. When snubber plunger 380 abuts the stop, the snubber plunger 380 projects out from actuator piston 200 a distance of $D_3$. Snubber plunger 380 is sized to form an annular clearance gap 351 between the plunger and the actuator piston 200. Clearance gap 351 provides the path for controlled fluid flow between chamber 365 and chamber 230.

The operation of this embodiment of the invention may be explained with further reference to FIGS. 23–25. FIG. 23 shows actuator piston 200 and snubber plunger 380 at rest. Due to the bias of the valve spring, the engine valve is seated, and actuator piston 200 is at its minimum stroke. As shown in FIG. 23, there is insufficient hydraulic pressure in chamber 230 to force actuator piston 200 downward against the upward bias of the valve spring. With actuator piston 200 at its at-rest position, as shown in FIG. 23, passageway 115 is aligned with horizontal passage 210. The communication path for low pressure hydraulic fluid to the lash adjustment means 600 is thus established. In this condition, lash adjustment means 600 may automatically take up any slack clearance between the actuator piston 200 and the engine valve 400.

Referring again to FIG. 23, when it is desired to actuate engine valve 400, hydraulic fluid under pressure is admitted to chamber 230 above actuator piston 200 through passageway 110. The hydraulic fluid acts against top surface of actuator piston 200 to move actuator piston 200 downward. Engine valve 400 also moves downward opening against the bias of the valve spring.

As actuator piston 200 moves downward to actuate engine valve 400, snubber plunger 380 moves upward relative to actuator piston 200. Hydraulic fluid entering chamber 230 flows through clearance gap 351 to fill the expanding volume of chamber 365.

Snubber plunger 380 continues to move upward relative to actuator piston 200, expanding the volume of chamber 365, until the motion of snubber plunger 380 is arrested by the mechanical stop (not shown). Once the motion of snubber plunger 380 relative to actuator piston 200 is arrested by the stop, snubber plunger 380 travels downward in concert with actuator piston 200 as actuator piston 200 continues to stroke downward under the force of the hydraulic fluid entering chamber 230.

Referring next to FIG. 24, at the appropriate time the valve actuation system will release the hydraulic fluid from chamber 230 above actuator piston 200. When the bias of the valve spring overcomes the downward force of the hydraulic fluid, actuator piston 200 begins to move upward and begins to close the engine valve 400. FIG. 24 depicts the actuator piston 200 in a condition of "free return."

Referring now to FIG. 25 which discloses that as engine valve 400 moves toward a closed position and begins to close, actuator piston 200 eventually comes within a distance $D_3$ of the housing 100. When actuator piston 200 reaches this point, the snubber plunger 380 contacts the housing 100. From that point on, until the engine valve closes, actuator piston 200, and with it engine valve 400, are in a condition of snubbed return. During snubbed return, snubber plunger 380 is forced against the bias of snubber plunger return spring 390 into chamber 365 in actuator piston 200. The speed of upward motion of actuator piston 200 is limited to that of snubber plunger 380 relative to actuator piston 200.

During snubbed return, the snubber plunger 380 moves further into chamber 365 of actuator piston 200. Snubber plunger 380 displaces hydraulic fluid from chamber 365. The hydraulic fluid exits chamber 365 through clearance gap 351. During snubbed return, the rate of movement of snubber plunger 380 into chamber 365 is limited to the rate of which hydraulic fluid from chamber 365 is discharged through clearance 351. The return velocity of actuator piston 200 and seating velocity of engine valve 400 is thus limited by the rate of fluid discharge from chamber 365 through clearance 351.

When engine valve 400 is closed, actuator piston 200 will again be at its rest position, as shown in FIG. 23. The actuation cycle of the engine valve may then begin anew.

Figure 26:
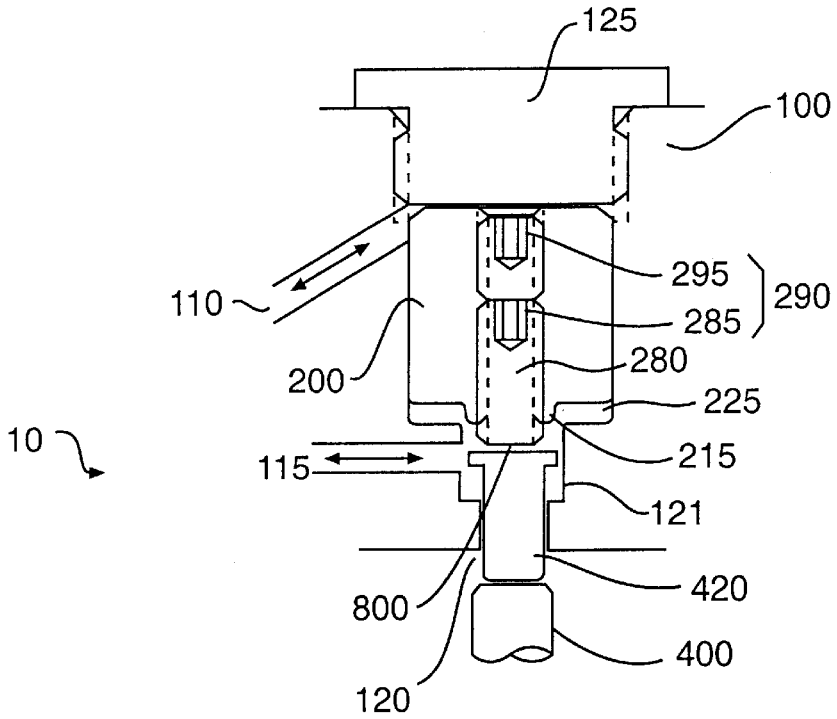
FIG. 26 is a cross-sectional view of an embodiment of the invention which includes a dampening mechanism to limit the maximum travel of the actuator piston assembly.

Reference will now be made to FIG. 26 which discloses a further embodiment of the present invention. The actuator 10 disclosed in FIG. 26 comprises a housing 100 and an actuator piston 200 slidably disposed therein.

A housing 100 is provided with a first passageway 110. Housing 100 further includes an internal bore 120 for receiving actuator piston 200. Passageway 110 is fluidically connected to bore 120 and provides high pressure fluid to the area above the actuator piston 200. The high pressure fluid may be hydraulic fluid. An end cap assembly 125 is secured to the housing 100 and closes the upper end of the bore 120. A further passageway 115 is provided within the housing 10 and is fluidically connected to the lower end of bore 120. The passageway 115 provides a low-pressure supply and drain of hydraulic fluid to the bore 120.

An actuator piston 200 is slidably located within the bore 120 in the housing 100. The actuator piston 200 includes a lash adjusting assembly 290. The lash adjusting assembly 290 includes a lash adjusting pin 285 that is movably mounted within a central passageway 280 within the actuator piston 200. The lash adjusting assembly 290 further includes a locking pin 295 to secure the lash adjusting pin 285 in a desired location.

The lash adjuster 290 extends from the lower end of the actuator piston assembly 200. The lash adjuster 285 is capable of contacting a follower assembly 420 that is reciprocally located in a lower extended portion of the bore 120. The follower assembly 420 transfers motion from the actuator piston 200 to an engine valve 400 which activates at least one exhaust valve. The follower assembly 420 also prevents the drainage of hydraulic fluid from the lower end of the second passageway 120.

The actuator piston 200 further comprises a first damping assembly 800. The first damping assembly 800 limits the maximum or downward travel of the actuator piston 200. This prevents overtravel of the engine valve 400. Furthermore, the first damping assembly 800 reduces wear and prevents damage to the actuator piston 200 because it provides a cushion to prevent the lower end of the actuator piston 200 from contacting the end of the bore 120.

The first damping assembly 800 includes a reduced diameter projection 215 extended from the lower end of the actuator piston 200. The reduced diameter projection 215 is sized to be received within a reduced diameter portion 121 of the bore 120, as shown in FIG. 26.

Figure 27:
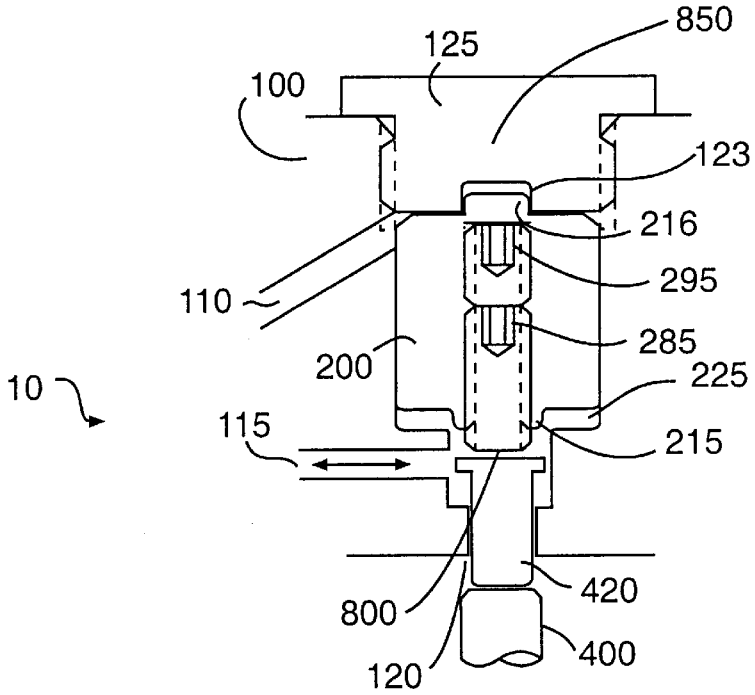
FIG. 27 is a cross-sectional view of an embodiment of the invention which includes a dampening mechanism to limit the maximum and minimum travel of the actuator piston assembly.

A second damping assembly 850 is illustrated in FIG. 27. The second damping assembly 850 limits the minimum or upward travel of the actuator piston 200 within the bore 120. The second damping assembly 850 controls the seating velocity of the actuator piston 200 as well as the initial velocity of the actuator piston at the start of the lift of actuator piston 200. The second damping assembly 850 includes a reduced diameter projection 216 extended from an upper end of the actuator piston 200. The reduced diameter projection 216 is sized to be received within a cavity 123 within the end cap 125.

The operation of the first damping assembly 800 and the second damping assembly 850 will now be described. Hydraulic fluid is supplied through the first passageway 110 to the area in bore 120 above the actuator piston 200 in order to initiate downward movement of the actuator piston 200. The first part of the stroke of actuator piston 200 may be restricted due to the configuration of the second dampening assembly 850. As hydraulic fluid enters the bore 120, the actuator piston 200 is moved downward. This movement causes hydraulic fluid located in the lower end of the bore 120 to drain through passageway 115. When the reduced diameter projection 215 is received within the reduced diameter portion 121 of the bore 120, hydraulic fluid is trapped in area 225 between the lower end of the actuator piston 200 and the surface of the bore 120. The trapped hydraulic fluid forms a cushion in area 225 to limit the downward travel of the actuator piston 200.

During the upward stroke of the actuator piston 200, hydraulic fluid from the passageway 115 and the upward movement of the follower 420 move the actuator piston 200 in an upward direction. Hydraulic fluid located above the actuator piston 200 is permitted to drain through the passageway 110. The reduced diameter projection 216 then enters the cavity 123 in the end cap 120. At this point, hydraulic fluid located within the cavity 123 must pass through restricted clearance between 216 and 123 to get to the passageway 110. This hydraulic fluid within the cavity 123 forms a cushion to control the upward movement of the actuator piston 200 and limits the seating velocity of the engine valve 400.

It will be apparent to those skilled in the art that various modifications and variations can be made in the construction and configuration of the present invention without departing from the scope or spirit of the invention. The invention may comprise part of a lost motion, common rail, or other hydraulic valve actuation system. Various modification and variations can be made in the construction of the actuator 10 described above without departing from the scope or spirit of the invention. For example, actuator piston 200 and housing 100 may be of a variety of sizes and cross-sectional shapes as long as actuator piston 200 is slidably disposed within housing 100. Likewise, snubber plunger 380 and plunger housing 385 may be of a variety of mutually compatible sizes and cross-sectional shapes. The flow of hydraulic fluid should be properly metered to provide the desired snubbing of actuator piston 200 and engine valve 400. Further, it may be appropriate to make additional modifications, such as including different types of lash adjustment means for means of connection to an engine valve, or other valves, depending on the engine or system in which the invention is to be used. Thus, it is intended that the present invention cover the modifications and variations of the invention provided they come within the scope of the appended claims and their equivalents.

What is claimed is:

1. A hydraulic valve actuator for operating an engine valve comprising:

an actuator housing;

an actuator piston having upper and lower ends, wherein said piston is reciprocally disposed within said housing and is adapted to be moved upward and downward in response to hydraulic pressure; said lower end of said actuator piston is operatively connected to the engine valve so that the engine valve opens when said actuator piston is displaced downward in response to hydraulic pressure upon said upper end, and when the hydraulic pressure is removed from said upper end said actuator piston returns upward and the engine valve shuts, said actuator piston further comprising: a pin; a pin body; and a piston body; wherein said pin is reciprocally disposed within said pin body and said pin body is disposed within and fixed to said piston body, and said piston body is reciprocally disposed within said housing;

a feed and drain passage in said housing to allow hydraulic fluid to move to and from said upper end of said actuator piston; and a control element disposed within said actuator housing, wherein said control element provides a restriction in hydraulic fluid flow during a portion of the return stroke of said actuator piston thereby limiting the velocity of the actuator piston, wherein said actuator piston includes longitudinal and transverse passages which allow fluid to move from said feed and drain passage to the upper end of said piston.

2. The hydraulic actuator of claim 1, wherein said pin body extends downward from said piston body and is operatively connected to the engine valve.

3. The hydraulic actuator of claim 1, wherein said pin is biased upward away from the engine valve.

4. The hydraulic actuator of claim 1, wherein said piston body includes a longitudinal passage and an transverse passage.

5. The hydraulic actuator of claim 4, said piston body having an upper end and wherein said pin extends through said longitudinal passage at said upper end of said piston body.

6. The hydraulic actuator of claim 5, wherein said pin includes a large diameter section so that during the return stroke of the actuator piston said large diameter section of said pin contacts said housing and is forced into said longitudinal passage creating a flow restriction and slowing the velocity of the actuator piston.

7. The actuator of claim 5, wherein said pin includes a longitudinal passage and an upper and lower orifice connecting the longitudinal passage to the exterior of the pin.

8. The actuator of claim 7, wherein said pin includes a large diameter section so that during the return stroke of the actuator piston said large diameter section of said pin contacts said housing and is forced into said longitudinal passage substantially cutting off the flow of hydraulic fluid between the piston body and the pin so that fluid flows through the upper and lower orifices thereby creating a flow restriction and slowing the velocity of the actuator piston.

9. The hydraulic actuator of claim 1, wherein said actuator further includes a means for adjusting for engine valve lash.

10. The hydraulic actuator of claim 9, wherein said means for adjusting for engine valve lash comprises: an adjustable sleeve disposed between said actuator piston and said housing and a lash adjustment screw threaded into said housing and contacting said sleeve for adjusting the position of said adjusting sleeve within said housing.

11. The hydraulic actuator of claim 9, wherein said means for adjusting for engine valve lash comprises: a lash piston disposed reciprocally within said lower end of said actuator piston; a lash compression spring disposed above said lash piston for biasing said lash piston toward the engine valve; and a lash adjustment chamber located within said actuator piston above said lash piston for establishing an hydraulic link between said actuator piston and said lash piston.

12. A hydraulic valve actuator for operating an engine valve comprising:

an actuator housing having a vertically aligned central bore;

an actuator piston having upper and lower ends, wherein said piston is reciprocally disposed within said central bore and is adapted to be moved upward and downward in response to hydraulic pressure; said lower end of said actuator piston is operatively connected to the engine valve so that the engine valve opens when said actuator piston is displaced downward in response to hydraulic pressure upon said upper end, and when the hydraulic pressure is removed from said upper end said actuator piston returns upward and the engine valve shuts;

an end cap located above said actuator piston to seal off the upper end of said central bore and retain said actuator piston;

a feed and drain passage in said housing to allow hydraulic fluid to move to and from said upper end of said actuator piston; and a dampening assembly comprising a cavity on the downward side of said end cap, wherein said cavity is capable of receiving the upper end of said actuator piston so that during the return stroke of said actuator piston hydraulic fluid is trapped in said cavity forming a cushion and reducing the velocity of said actuator piston.

13. The hydraulic actuator of claim 12, wherein said upper end of said actuator piston includes a projection section capable of fitting within said cavity.

14. The hydraulic actuator of claim 12, wherein said lower end of said central bore includes a reduced diameter section and said actuator piston includes a projection capable of fitting within said reduced diameter section of said central bore so that during the opening of said engine valve a cushion is formed which limits the movement of said engine valve.

15. The hydraulic actuator of claim 12, further comprising a means for adjusting the actuator for variations in engine valve lash.

16. The hydraulic actuator of claim 15, wherein said means for adjusting comprises:

a vertically aligned central passage located within in said actuator piston;

an adjustable pin threaded into said central passage projecting downward from said actuator piston to operatively connect with the engine valve; and a locking pin located in said central passage above said adjustable pin to secure said adjustable pin in position.

* * * * *